United States Patent [19]

Johnson

[11] Patent Number: 4,482,308

[45] Date of Patent: Nov. 13, 1984

[54] APPARATUS FOR FORMING DRY LAID WEBS

[75] Inventor: Jeffrey J. Johnson, Lynchburg, Va.

[73] Assignee: The James River Corporation, Conn.

[21] Appl. No.: 460,986

[22] Filed: Jan. 25, 1983

[51] Int. Cl.[3] ..... B29J 1/00

[52] U.S. Cl. ..... 425/83.1

[58] Field of Search ..... 425/83.1

[56] References Cited

U.S. PATENT DOCUMENTS

| | | | |
|---|---|---|---|
| 2,969,104 | 1/1961 | Schubert et al. . | |
| 3,748,693 | 7/1973 | Jespersen . | |
| 3,834,869 | 9/1974 | Ancelle et al. . | |
| 4,004,323 | 1/1977 | Gotchel et al. | 425/83 |
| 4,014,635 | 3/1977 | Kroyer | 425/82 |
| 4,035,870 | 7/1977 | Reba et al. | 156/62.2 |
| 4,081,501 | 3/1978 | Muther | 264/121 |
| 4,111,294 | 9/1978 | Carpenter et al. | 425/83.1 |
| 4,180,378 | 12/1979 | Mielke | 425/83.1 |
| 4,264,290 | 4/1981 | Dunkerly et al. | 425/83.1 |
| 4,276,248 | 6/1981 | Widnall | 264/121 |
| 4,285,647 | 8/1981 | Dunkerly | 425/83.1 |

*Primary Examiner*—James R. Hall

*Attorney, Agent, or Firm*—Finnegan, Henderson, Farabow, Garrett, & Dunner

[57] ABSTRACT

An apparatus for depositing a uniform web of dry fibers on a foraminous wire moving at speeds greater than 500 feet per minute including offset suction and air deflecting means within a fiber distributor for imparting a horizontal velocity component to the deposited fibers in the direction of the moving wire, also a method for depositing a uniform web of dry fibers onto a moving foraminous wire including imparting a horizontal velocity component to fibers deposited onto the wire in the direction of the wire by inducing a pressure gradient and baffling the air flow within a fiber distributor.

12 Claims, 5 Drawing Figures

FIG. 1
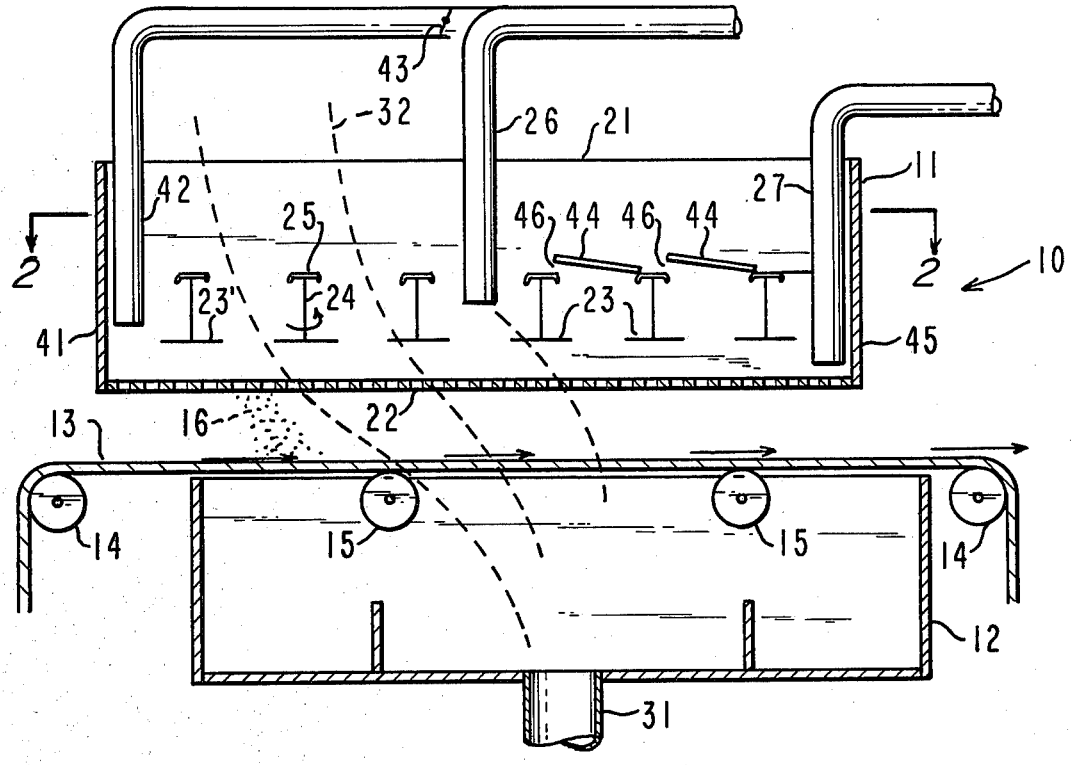
FIG. 2
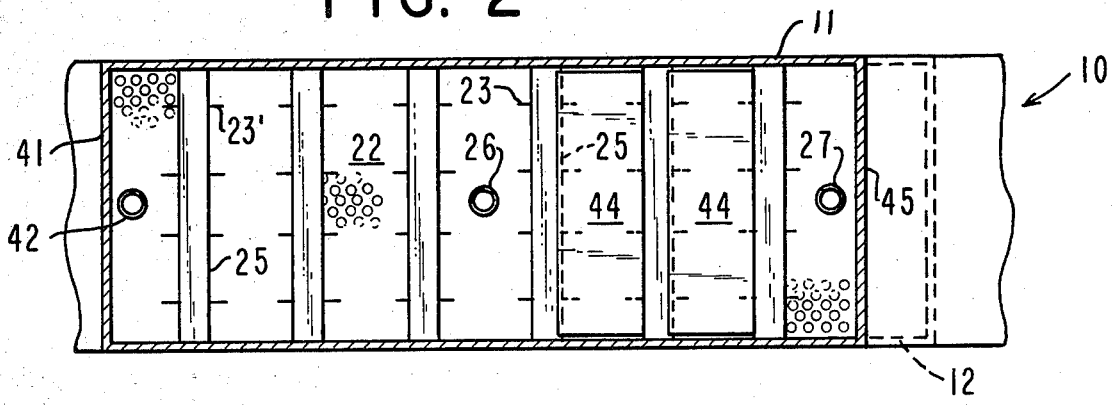
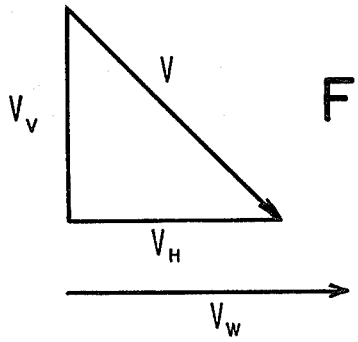
FIG. 3

GRAPHIC ILLUSTRATION OF THE EFFECT OF THE INVENTION ON FIBER INCIDENCE ANGLE ALONG THE LENGTH OF THE DISTRIBUTOR

APPARATUS FOR FORMING DRY LAID WEBS

FIELD OF THE INVENTION

This invention relates to an improved apparatus for the formation of a uniform dry laid web of non-woven fibers. More particularly, this invention relates to an apparatus for forming uniform air laid webs by depositing dry fibers on a foraminous wire moving at high speeds.

BACKGROUND OF THE INVENTION

The production of non-woven webs involves the dry forming of fibrous materials, such as dry fibers, filaments, and particulate matter onto a moving forming surface. In systems for dry-forming fibrous materials, critical process limitations have been found to exist in systems where the speed of the forming surface increases to greater than 500 feet per minute. At such high speeds, fiber lay-down on the moving forming surface tends to become uneven in the machine direction. The deposited webs exhibit an upper surface having an undulated, wave-like or ripple effect extending in the cross-machine direction and the webs exhibit corresponding variations in thickness, and basis weight. The rippling effect worsens with increasing speed of the forming surface, and eventually renders the web commercially unacceptable when a certain high range of speed of the forming surface is used.

Commonly assigned U.S. Pat. No. 4,276,248 to Widnall describes the problems associated with the formation of dry laid non-woven webs, particularly at wire speeds of greater than 500 feet per second and offers some solution to these problems. As disclosed therein, a critical fiber velocity relationship exists which can alleviate these detrimental wave characteristics in the web. This relationship, hereinafter "formation ratio", provides that the magnitude of the difference between the foraminous wire or web horizontal velocity and the fiber horizontal velocity component divided by the vertical velocity component of the fibers should be less than 3.0, preferably less than 2.5.

Attempts to alleviate the above-described problems are described in U.S. Pat. No. 4,264,290 to Dunkerly et al. (herein "Dunkerly et al.") and U.S. Pat. No. 4,285,647 to Dunkerly (herein "Dunkerly"), both commonly assigned. These patents illustrate certain means for inducing a horizontal velocity component to dry-laid fibers. Dunkerly et al. and Dunkerly show that a suction box beneath a moving foraminous wire may be offset in the machine or downstream direction to induce a horizontal velocity to the dry-laid fibers. That is, the upstream wall of the suction box lies beneath the distributor and is displaced by a finite distance from the distributor upstream wall, while the downstream suction box wall extends beyond the distributor to draw fiber-laden air in the direction of the moving wire.

Dunkerly et al. and Dunkerly also show additional means for inducing a horizontal component to dry-laid fibers to augment the effect of offset suction. Dunkerly et al. teaches use of a plurality of foils directing air horizontally into the gap between a fiber distributor and forming wire. Dunkerly illustrates various vane and deflector arrangements directing air horizontally within a fiber distributing system above the forming wire.

The present invention provides new means for accelerating fibers in the horizontal direction to alleviate the aforementioned problems to produce a uniform dry-laid web at high speeds, and may be used alone or in combination with existing systems.

SUMMARY OF THE INVENTION

It is an object of the present invention to provide improved apparatus for depositing a uniform web of dry fibers onto a foraminous wire moving at high speeds to alleviate the problems associated with the rippling effect of forming dry-laid webs at high speeds.

Additional objects and advantages of the invention will be set forth in part in the description which follows and in part will be obvious from the description, or may be learned by practice of the invention. The objects and advantages of the invention are realized and obtained by means of the apparatus, particularly pointed out in the appended claims.

To achieve the objects in accordance with the purposes of the invention, as embodied and broadly described herein, the invention is an apparatus for depositing a uniform web of dry fibers onto a foraminous wire moving at speeds greater than 500 feet per minute in a horizontal, upstream-to-downstream direction. The apparatus comprises a fiber distributor disposed above the foraminous wire, the distributor having a plurality of connected side walls, a foraminous bottom, fiber inlet means for introducing dry fibers into the distributor and an air inlet at the top of the distributor, and means to disperse fibers on the wire moving below the distributor; a suction box disposed below the wire and offset from a relative position of the fiber distributor in a downstream direction of the moving foraminous wire; and at least one air deflector means located in the distributor above the dispersing means, said air deflector means, preferably, being movable to a deflecting position and to a second position permitting passage of an increased flow of air and fibers, said air deflector means in the deflecting position extending horizontally covering between 10% to 40% of a horizontal cross section of the distributor and positioned adjacent the downstream outermost wall of the distributor for forming a zone of low pressure beneath said air deflecting means, wherein fibers introduced into the distributor acquire a horizontal velocity component in the downstream direction which is greater than the component would be in the absence of the inlet air deflector means. In a preferred embodiment of the invention, the apparatus includes a centrally positioned fiber distributor inlet and a second fiber distributor inlet proximate to the outer upstream wall of the distributor for introducing dry fibers into the distributor. In a more preferred embodiment of the invention, the average angle of incidence of the dry fibers being deposited upon the foraminous wire is less than 50° and more preferably less than 40°, wherein the difference between the horizontal velocities of the foraminous wire and the dry fibers being deposited onto the foraminous wire is less than 2.5 times the vertical velocity component of the fibers and more preferably 1.5 times the vertical velocity component of the fibers.

The invention further provides the formation of dry-laid, non-woven webs on a foraminous wire moving horizontally in an upstream-to-downstream direction substantially free of cross-machine ripples at forming speeds of greater than 500 feet per minute. The invention comprises introducing fibers into a distributor disposed above the foraminous wire for downward dispersion of the fibers onto the moving foraminous wire, the fibers being introduced proximate the upstream end of the distributor relative to the moving wire; inducing a pressure gradient in the downstream direction by means of a suction box disposed beneath the foraminous wire offset in a downstream direction relative to the distributor and drawing air through a top end of the distributor; and creating a zone of reduced pressure in the downstream end of the distributor by use of baffling to impart an increased horizontal velocity component to the fibers being dispersed upon the foraminous wire. In a preferred embodiment, the fibers are introduced into the distributor in a central portion of the distributor in addition to introduction of the fibers proximate to the upstream end of the distributor. In a more preferred embodiment of the invention, the average angle of incidence of the dry fibers being deposited upon the foraminous wire is less than 50° and more preferably less than 40°, and the difference between the horizontal velocities of the foraminous wire and the dry fibers being deposited onto the foraminous wire is less than 2.5 times the vertical velocity component of the fibers and more preferably 1.5 times the vertical velocity component of the fibers.

It is to be understood that both the foregoing general and the following detailed description are exemplary and explanatory only and are not intended to be restrictive of the invention as claimed.

BRIEF DESCRIPTION OF THE DRAWINGS

FIG. 1 is a side view, taken mostly in cross section, illustrating the device of this invention as used with a fiber distributor and a vertically offset suction box.

FIG. 2 is a cross-sectional view across section 2—2 of FIG. 1.

FIG. 3 is a vector diagram of the fiber laden air impinging on the forming wire.

DETAILED DESCRIPTION OF THE INVENTION

Figure 4:
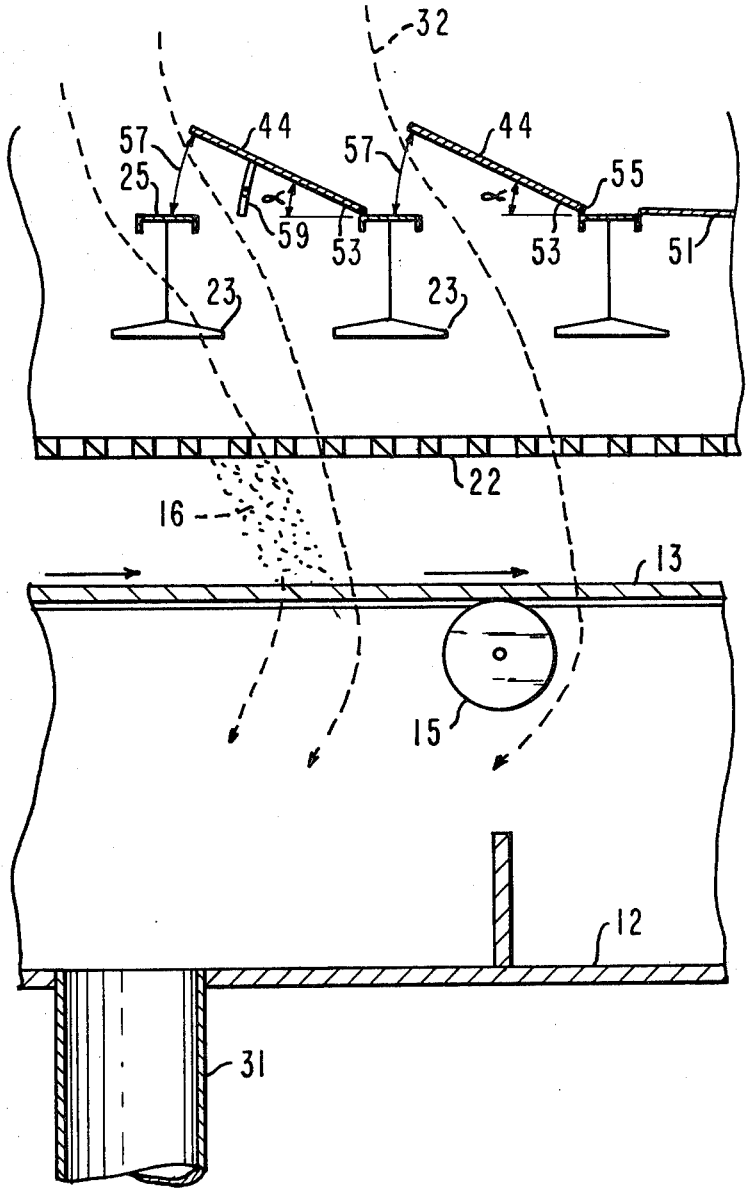
FIG. 4 is a side view, taken mostly in cross-section, illustrating the baffling means of the invention in greater detail than shown in FIG. 1.

Reference will now be made in detail to the present preferred embodiments of the invention, examples of which are illustrated in the accompanying drawings.

Referring to FIGS. 1 and 2, in accordance with the invention the apparatus for dry forming an air laid nonwoven web is designated generally by numeral 10. The apparatus 10 comprises a distributor 11, a suction box 12, and a foraminous forming wire 13. The wire is in horizontal transit from left (upstream) to right (downstream) in FIG. 1 as indicated by the arrows, and moves along guide rolls 14 and table rolls 15 between the distributor 11 and the suction box 12. The distributor 11 is disposed above the forming wire 13 and the suction box 12 is disposed below the forming wire 13.

The distributor 11 is essentially box-shaped, and has a top end 21 open to the atmosphere, and a bottom end which is provided with a screen 22. Of course, the top end may be enclosed, and provided with air intake vents in order to provide an inlet for air. A plurality of rows of impellers 23, serially arranged in the machine direction, are located within the distributor 11 proximate the screen 22 and provide means to disperse fibers through the screen and onto the wire 13 below. The impeller shafts 24 are rotatably suspended from cross beam members 25, which are positioned in the upper region of the distributor as known in the art. Typically, the distributor of the type described has from three to ten, preferably six, rows of impellers.

In prior art machines, a centrally positioned fiber inlet conduit 26, here adapted to top entry, introduces loose fibers into the distributor pneumatically, while recycle conduit 27 recycles oversized fibers back to the fiber comminution means (not shown). Dispersion of the fibers in the distributor onto and through the screen 22 is achieved by impellers 23 as is known in the art.

The suction box 12 having outlet port 31 is disposed beneath the distributor in offset relationship as described in U.S. Pat. No. 4,264,290 to Dunkerly et al. Due to the offset, an air stream drawn into the distributor and through the suction box by vacuum producing means (not shown) in communication with port 31 has imparted to it a curvilinear flow path illustrated by dashed lines 32. Hence, fibers 16 impinging on wire 13 receive a horizontal velocity component $V_H$ as depicted in the vector diagram of FIG. 3. Thus, the fibers 16, relative to the wire 13 moving at velocity $V_W$, have a horizontal velocity difference $V_F$ equal to the difference between $V_W$ and $V_H$, and are incident upon the wire at an angle equal to arc tan ($V_V/V_H$). The ripple effect as defined in U.S. Pat. No. 4,276,248, to Widnall, intrinsically associated with webs obtained from the above-described apparatus at wire speeds greater than 500 fpm is alleviated as the formation ratio, in absolute values $V_F/V_V$, decreases, the limiting value of the ratio for adequate formation being less than about three. The ratio, at a fixed vertical velocity component $V_V$, thus decreases as $V_H$ increases and the angle decreases.

The above arrangement may be further improved according to the following features of the preferred embodiments in accordance with the invention. Since fibers from inlet 26 receive a horizontal velocity in the machine direction during residence within the distributor itself, the upstream portion of the distributor proximate to wall 41 is "starved" for fibers. The impellers 23 do not provide sufficient fiber momentum to propel the fibers toward wall 41 to thereby overcome the maldistribution problem. This difficulty is rectified by placing a second fiber inlet conduit 42 proximate the wall 41, preferably between the wall and the adjacent row of impellers 23. The amount of fibers directed to inlet 42 can be regulated by diverter valve 43 therein, or other means well known in the art.

By curing the maldistribution problem, the horizontal fiber velocity component $V_H$ can be increased thereby reducing the formation ratio. To do this the fiber free air stream entering through top end 21 is provided with a horizontal velocity component by inducing a pressure gradient in the machine direction within the distributor 11. The gradient is obtained by placing one or more baffles transversely of the wire 13 and in the distributor 11, the baffles extending inwardly from the direction of downstream wall 45. To prevent fiber accumulation above the baffles 44, it is necessary that the level at which the baffles are situated be above the outlets of the fiber inlets 26 and 42. The baffles 44 are hingeably supported by cross beam members 25, the gradient being regulated by the size of the opening 46 between a free edge of the baffle and the adjacent cross member. Typically, the baffles are at an angle of 0° to 30° and preferably between 5° and 15° from the horizontal. In lieu of hinged baffles 44, louvres with adjustable dampers can be used.

FIG. 4 illustrates, with greater detail, adjustable baffle means in accordance with the invention. The adjustable baffles 44 are mounted on the cross members 25 by means of a hinge member designated generally as 53 rotating about a hinge pin 55. The baffles 44 are adjusted by any suitable mechanical means (not shown) acting upon the hinge member 53 to raise the baffle and create an opening 57 for air flow to pass through. The position of the baffle is preferably adjusted at an angle from the horizontal between a closed position =0° or an open position where =30°. The angle of the baffle 44 and size of the opening 57 is adjusted as desired to control the air flow amount and direction to meet intended purposes. Preferably, the baffles are adjusted to an angle of between 5° and 15° from the horizontal. The baffles 44 may optionally be connected to locking means 59 for locking the baffle at the desired raised angle. Choosing a suitable type of locking means employed is within the skill of one in the art. Stationary baffle means 51 may extend substantially horizontally from the cross member 25 to the downstream wall (not shown, see 45 of FIG. 3).

Generally, 10 to 40% of the distributor cross section may be baffled, preferably 20% to 30%. Pressure gradients as measured between outer walls 41 and 45, range from a lower limit of 0.5 inches of water up to a maximum of 1.5 inches water, the normal operating range being 1.0 inches water. The induced incremental horizontal velocity component can be from 0 fpm up to 300 fpm, with the optimum incremental increase being something less than 200 fpm.

Figure 5:
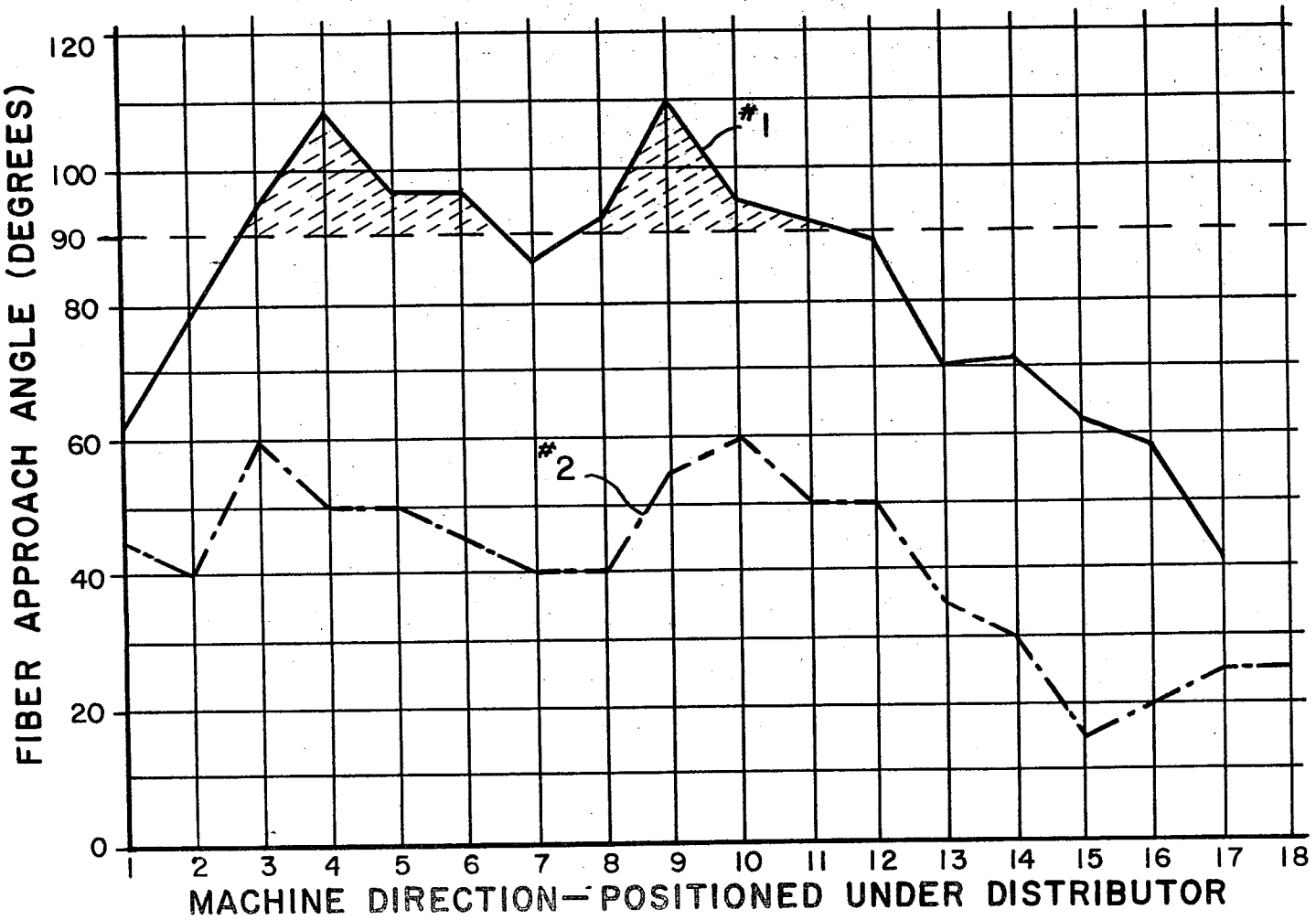
FIG. 5 provides graphical data illustrating the effect of the invention on fiber incidence angle along the length of the distributor.

FIG. 5 illustrates graphically by curve #1 and #2 the comparative advantages that accrued in tests of the baffled and conventional units. The distributor had six rows of impellers, while the suction box was off-set by about one row. In each instance, the vertical velocity $V_V$ was 300 fpm with the wire traveling anywhere from 500 fpm to 1300 fpm, but most frequently at about 900 fpm.

The abscissa parameter is the distance travelled by the web in feet from the upstream wall 41 of the distributor, while the angle of incidence is plotted on the coordinate. Curve #1 is for an unbaffled machine; curve #2 is for a machine wherein baffles were placed above the two rows of impellers adjacent the downstream wall.

The average angle of incidence of the unbaffled machine represented by curve #1 was 82.4° which is equivalent to a $V_H$ of 40 fpm. In the baffled machine represented by curve #2 the average angle of incidence was 40.8°, and the equivalent $V_H$ was 347 fpm. The peaks at measurement locations 3, 4, 9 and 10 were caused by table rolls, such as rolls 15, which prevent wire sag. It should be noted in curve #1, the shaded peaks indicate fibers travelling in the reverse machine direction (angle of incidence of greater than 90°). Fiber approach angles of greater than 90° work against good web formation. Whereas, in the baffled configuration, the fibers are shown in curve #2 to be accelerating and travelling in the machine direction along the entire length of the distributor.

The scope of the present invention is not limited by the description, examples and suggested uses herein, and modifications can be made without departing from the spirit of the invention. For example, various suction box modifications for achieving preferred air stream flow paths are known to the art, such as partitioning the lower section thereof, and can be used in combination with the invention. Thus it is intended that the present invention cover the modifications and variations of this invention provided they come within the scope of the appended claims and their equivalents.

What is claimed is:

1. An apparatus for depositing a uniform web of dry fibers onto a foraminous wire moving at speeds greater than 500 feet per minute in a horizontal upstream-to-downstream direction comprising:

a fiber distributor disposed above said wire, said distributor having a plurality of connected side walls a downstream wall, and a foraminous bottom wall, fiber inlet means for introducing dry fibers into the distributor and an air inlet at the top of the distributor, and means to disperse fibers onto the wire moving beneath the distributor;

a suction box disposed below said wire and offset from the relative position of the fiber distributor in the downstream direction of the moving foraminous wire; and at least one inlet air deflector means located in the distributor above the dispersing means, said deflector means extending horizontally to cover between 10% to 40% of a horizontal cross section of the distributor, and positioned adjacent the downstream wall of the distributor for forming a zone of low pressure beneath said air deflector means wherein fibers introduced into the distributor acquire a horizontal velocity component in the downstream direction which is greater than the component would be in the absence of said inlet air deflector means.

2. An apparatus according to claim 1, wherein said fiber inlet means includes a first centrally positioned fiber distributor inlet and a second fiber distributor inlet proximate the outer upstream wall of the distributor for introducing dry fibers into the distributor.

3. An apparatus according to claim 2, wherein the outlets of the first and second fiber distributor inlets are positioned below the level of the air deflector means.

4. An apparatus according to claim 1, wherein the suction box imparts a vertical velocity component to the distributed fibers at the forming area of at least 300 feet per minute.

5. An apparatus according to claim 1, wherein the foraminous wire moves in a horizontal downstream direction at speeds in the range of from 500 to 1300 feet per minute.

6. An apparatus according to claim 1, wherein said deflector means include baffle plates extending through the distributor in the cross machine direction, said plates being hingeably adjustable to vary said pressure gradient, and covering between 20% and 30% of the distributor cross section.

7. An apparatus according to claim 6, wherein each baffle plate is rotatably mounted on a pin.

8. An apparatus according to claim 2, wherein the deflector means include baffle plates extending through the distributor in the cross machine directon, said plates being hingeably adjustable to vary said pressure gradient, and covering between 20% and 30% of the distributor cross section.

9. An apparatus according to claim 1, wherein the average angle of incidence of the fibers being deposited upon the foraminous wire is less than 50°.

10. The apparatus of claim 5, wherein the difference between the horizontal velocities of the foraminous wire and the fibers being deposited onto the foraminous wire is less than 2.5 times the vertical velocity component of the fibers.

11. An apparatus according to claim 1, wherein the average angle of incidence of the fibers being deposited upon the foraminous wire is less than 40°.

12. The apparatus of claim 9, wherein the difference between the horizontal velocities of the foraminous wire and the fibers being deposited on the wire is less than 1.5 times the vertical velocity component of the fibers.

* * * * *